United States Patent [19]

Feldstein

[11] 4,144,361

[45] Mar. 13, 1979

[54] METHODS FOR APPLYING METALLIC SILVER COATINGS

[76] Inventor: Nathan Feldstein, c/o Surface Technology Inc., Box 2027, Princeton, N.J. 08540

[21] Appl. No.: 813,242

[22] Filed: Jul. 6, 1977

[51] Int. Cl.[2] ..... B05D 1/02; B05D 1/36; B05D 1/18

[52] U.S. Cl. ..... 427/162; 427/164; 427/168; 427/169; 427/304; 427/426; 427/437

[58] Field of Search ..... 427/168, 169, 304, 164, 427/162, 426, 437

[56] References Cited

U.S. PATENT DOCUMENTS 2,602,757 7/1952 Kantrowitz et al. ..... 427/426 X

*Primary Examiner*—James R. Hoffman

*Attorney, Agent, or Firm*—Joel Spivak

[57] ABSTRACT

High efficiency deposition of silver onto substrates is obtained by utilizing admixed compositions comprising reducible silver ions, complexing agent, reducing agent in the presence of a promoter which is a soluble compound of germanium, tin or lead.

8 Claims, No Drawings

METHODS FOR APPLYING METALLIC SILVER COATINGS

BACKGROUND OF THE INVENTION

This invention relates to methods and compositions for electroless deposition of metallic silver on miscellaneous substrates. Electroless silver deposition, or as it is also known in the art as silver spray or aerosol deposition, is an old art finding utility in diverse products ranging from mirrors to decorative plastics and phonograph record masters. The state of the art and its evolution is well documented in many publications and issued patents. The following are just a few describing the subject and they are included herein by reference.

1. S. Wein, "Metallizing Non-Conductors," Finishing Publication, Inc., (1945).
2. W. Goldie, "Metallic Coating of Plastics," Electrochemical Publication Limited, (1968), Vol. 1, and in particular Chapter II.
3. D. J. Levy et al, Plating, November (1965). D. J. Levy et al, Sampe Jr., April/May (1969). D. J. Levy et al, J. Electochem. Soc., 121, 484 (1974).
4. U.S. Pat. Nos. 2,367,903; 2,439,654; 2,664,363; 2,822,289; 2,214,476; 2,602,757; 2,614,943; 3,963,842; 3,776,740 and 3,983,266.

In general, electroless silver (or spray) is deposited upon a properly sensitized substrate (or a proper catalytic surface) utilizing dual spray guns wherein the individual streams are atomized and react to precipitate by a chemical reduction metallic silver. Generally speaking, in the aerosol spray technique, there are at least two main streams encompassing two solutions; the first comprises a soluble silver salt along with a suitable complexing agent and the second is a reducing agent along with a pH adjustor. Typical compositions in the prior art have utilized silver nitrate as the source for the silver ions and ammonia as the complexing agent. Reducing agents commonly reported are, but are not limited to, hydrazine and its derivatives, formaldehyde, sugars, etc. Inherent with such process of spray, there is always a certain quantity of silver which precipitates in a sludge rather than the desired coating thereby reducing the efficiency of the deposition process. Thus, there has been a continuous search for means by which the efficiency of the deposition process can be improved through reducing the quantity of sludge formation. Examination and evaluation of commercially available solutions or solutions prepared from the above references still reveals the presence of comparatively high quantities of the undesired silver sludge formation. It is thus recognized that there is still a need for improved compositions which would provide a more efficient process for the silver spray deposition process or for the increased plating rate of electroless silver deposition.

SUMMARY OF THE INVENTION

Method for applying novel compositions which are admixed for electroless (aerosol) deposition of silver. The novel composition comprises a soluble silver salt, a complexing agent for the silver ions, a reducing agent for ions, a pH adjustor, and a soluble promoting compound. The presence of the promoter improves the efficiency of the deposited silver by reducing the amount of sludge formation.

DETAILED DESCRIPTION OF THE INVENTION

The process and the compositions of the present invention are applicable to the electroless (aerosol) deposition of silver or in combination with other metals, as well as copper derived from the cupprous ions. Similar processes are known and are used to produce a wide variety of products ranging from mirrors to decorative plastics and the like.

The term "promoter" as used herein is intended to encompass compounds bearing the elements selected from the group consisting of germanium, tin and lead, and are preferably those inorganic compounds of such elements which are readily soluble in aqueous media. Accordingly, lead (II) is preferred. Also included are tungstate, vanadate, and similar compounds of other elements from the same groups and periods of the Periodic Table of the Elements. The incorporation of the promoter compound results in the increase of the deposition rate as well as the efficiency for the process, and diminishes the sludge formation.

The following examples are illustrative of the concept of the present invention and are not in limitation thereof. Moreover, it should be obvious to those skilled in the art that further optimization of adaptation to similar compositions is possible. It is also recognized that based upon trial procedure, optimum concentration of the promoter should be determined for each solution. The optimum value may vary not only from one composition to the next, but also with the conditions employed.

EXAMPLES 1-4

In the comparative testing of the prepared compositions the following procedure common to all was utilized.

1. Glass substrates were cleaned in a detergent solution and rinsed.
2. The cleaned substrates were sprayed with a sensitizer composition comprising acidic stannous chloride and rinsed.
3. The treated substrates were sprayed with the silver composition for 3 seconds with an air pressure of 60 psi and with all physical parameters held constant. After the silver spray the substrates were rinsed.
4. The optical density was measured (using a Weston Photographic Analyzer). This measurement reflects the amount of silver deposited onto the glass and hence relates directly to the efficiency of the process.

| Example Number | Compositions | Optical density | Remarks |
|---|---|---|---|
| 1 | control (no promoter) | 1.64 | sludge noted |
| 2 | same as No. 1 but $2 \times 10^{-5}$M $Pb(NO_3)_2$ promoter added to reducer | 1.70 | decreased quantity of sludge noted |
| 3 | same as No. 1 but $2 \times 10^{-5}$M $Na_2SnO_3$ promoter added to reducer | 1.69 | decreased quantity of sludge noted |
| 4 | same as No. 1 but $2 \times 10^{-5}$M (about) $Na_2G_eO_3$ promoter added to reducer | 1.67 | some sludge noted |

Conditions used: Spray temp. 13° C, pressure 60 psig and 3 sec spraying, distance of guns to substrate 17 inches Control compositions: Reducer was: 0.29M Hydrazine hydrate, 0.02M NaOH. Silver solution was: $Ag^+$-0.40M; 0.7M $NH_4OH$ I have also noted that as the temperature of the process is increased, the amount of silver deposited from the control solution is increased. While I do not wish to be bound by theory, it is believed that the effectiveness of the reducing agent is rate controlled by the formation of an active product(s) derived from the reducing agent, the latter of which is the effective reducer for the deposited ions.

EXAMPLE 5

I have also recognized that for a good spray composition, speed is essential at all the stages of the film growth especially during the initial stage about the sensitized surface. In order to examine the performance at the initial stage, a brief spray of 0.5 seconds was used controlled by a clock driven solenoid valve. The results are shown in optical density.

| Experiment | O.D. (Optical Density) |
|---|---|
| Same as Ex 1 with $Pb^{+2}$ of No. 2 | 0.70, 0.72 |
| Same as Ex 1 with $SnO_3^{-2}$ of No. 3 | 0.66, 0.72 |
| S-52 a commercial solution supplied by Peacock Laboratories, Phila., Pa. | 0.58, 0.56, 0.61 |

Analysis of the commercial silver solution (S-52) showed the absence of the additives (promoters) disclosed. I have also found that the incorporation of lead (II) is preferably made along with the reducer composition rather than the silver ammoniacal solution.

The higher speed of film formation of a given O.D. has allowed the use of lower concentrations of silver solution in the novel solutions as compared with commercial solutions thereby significantly reducing solution cost.

EXAMPLE 6

The incorporation of sodium tungstate within the reducer composition at a concentration of about $5\times10^{-4}$ molar showed a slight increase in the amount of silver deposited in a given period of time when compared to control solutions.

EXAMPLE 7

The incorporation of sodium vanadate showed distinctly a visual decrease in the amount of sludge formed when compared to the control. The concentration of this additive was about $2.5\times10^{-5}$ molar and it was incorporated within the reducer composition.

I have further recognized that in the chemical deposition of copper (e.g. spray technique) the promoter may be of significant value. Accordingly the incorporation of the present additives to copper deposition falls within the spirit of this invention.

What I claim is:

1. In a method of applying a coating of silver to a surface of a substrate utilizing a silver solution comprising reducible soluble silver ions in the presence of a reducing agent and a complexing agent, the improvement comprising concurrently applying to the surface of said substrate, a promoter and said silver solution and further wherein said promoter is a soluble compound of an element selected from the group consisting of germanium, tin and lead and mixtures thereof.

2. The method according to claim 1 wherein said reducing agent is selected from hydrazine and its derivatives.

3. The method according to claim 1 wherein said silver solution further contains a pH adjustor.

4. The method according to claim 1 wherein said complexing agent is ammonia.

5. The method according to claim 1 wherein said silver solution further contains a pH adjustor.

6. The method according to claim 1 wherein said substrate is sensitized with a stannous containing composition prior to applying the silver coating.

7. The method according to claim 1 wherein said coating of silver is carried forth via a spray method.

8. The method according to claim 1 wherein said soluble compound is a compound of lead(II).

* * * * *